US007735656B1

(12) United States Patent
Bassler

(10) Patent No.: US 7,735,656 B1
(45) Date of Patent: Jun. 15, 2010

(54) SELF-CLEARING ROTARY SCREENING SYSTEM

(76) Inventor: Alfred S. Bassler, 4994 Sheppard La., Ellicott City, MD (US) 21042

( * ) Notice: Subject to any disclaimer, the term of this patent is extended or adjusted under 35 U.S.C. 154(b) by 775 days.

(21) Appl. No.: 11/522,384

(22) Filed: Sep. 18, 2006

(51) Int. Cl.
*B07B 1/50* (2006.01)

(52) U.S. Cl. ..... 209/381; 209/270; 209/291; 209/627

(58) Field of Classification Search ..... 209/44.3, 209/687, 270, 284–306, 625, 627, 379, 381, 209/382, 385
See application file for complete search history.

(56) References Cited

U.S. PATENT DOCUMENTS 1,201,147 A * 10/1916 Chapman ..... 209/382
1,305,685 A * 6/1919 Beach ..... 209/381
2,086,551 A 7/1937 Heller
4,184,944 A * 1/1980 Tytko ..... 209/288
5,605,233 A 2/1997 Hauch
6,050,423 A 4/2000 Dunnuck et al.
6,220,447 B1 * 4/2001 Lambert ..... 209/382
6,422,394 B1 * 7/2002 Page ..... 209/383

* cited by examiner

*Primary Examiner*—Patrick Mackey
*Assistant Examiner*—Kalyanavenkateshware Kumar
(74) *Attorney, Agent, or Firm*—Rosenberg, Klein & Lee

(57) ABSTRACT

A self-clearing rotary screening system (300, 300', 300", 300'") includes a frame (110) having a longitudinally extending axis (112). The frame (110) includes a plurality of longitudinally extending frame members (114) disposed in angularly spaced relationship, one with respect to another, about the axis (112). The system (300, 300', 300", 300'") includes a plurality of screening members (116) fixed between respective pairs of the plurality of frame members (114) to define a longitudinally extending cavity (118). A drive system (120) is coupled to the frame (110) for rotating the frame (110) about the axis (112). The system (300, 300', 300", 300'") includes a plurality of displaceable members (210, 210', 310, 410) pivotally coupled to respective portions of the frame (110). The displaceable members (210, 210', 310, 410) are displaced responsive to rotation of the frame (110) about the axis (112).

17 Claims, 10 Drawing Sheets

SELF-CLEARING ROTARY SCREENING SYSTEM

BACKGROUND OF THE INVENTION

Field of the Invention

This invention directs itself to rotary screening systems for separating particulates by size. In particular, this invention directs itself to a self-clearing rotary screening system that prevents the formation of excessive clogging of the screening apparatus. Still further, this invention directs itself to a rotary screening system that includes a system of displaceable members, wherein each of a plurality of displaceable members are pivotally displaced responsive to rotation of a rotary framework of the rotary screening system. During rotation of the rotary framework, the displaceable members in the form of displaceable screening members are subjected to rapid deceleration that breaks loose agglomerations of material that are caked onto the screen. Additionally, the rapid deceleration of the displaceable screening members can be accompanied by impacts of one screening member striking another. More in particular, this invention pertains to a method of retrofitting a rotary screening apparatus which includes the steps of providing a plurality of longitudinally extending screening members, locating the screening members internal to a longitudinally extended material receiving cavity of the rotary screening apparatus in angularly spaced relationship, and pivotably mounting the plurality of screening members a distance one from another so that each of the screening members strikes an adjacent other of the screening members during rotation of the rotary screening apparatus. Still more in particular, this invention is directed to the inclusion of displaceable members in the form of flexible belts overlaying imperforate portions of the rotary screening apparatus. Agglomerations of material that have bound themselves to the flexible belts are loosened due to the gravitational effects on the belts during rotation of the rotary screening apparatus causes, thereby keeping the imperforate portions of the rotary screening apparatus clear. Yet further, this invention directs itself to a rotary screening system that includes a system of displaceable members in the form of a plurality of displaceable mallets. The plurality of mallets are arranged in sets that are angularly spaced one from another. Each set of mallets include a multiplicity of longitudinally spaced mallets that impact against the screens of the rotary screening apparatus responsive to the rotation thereof. Additionally the mallets of each set are different lengths to strike screens of rotary screening apparatus in different areas.

PRIOR ART

Rotary screening systems are well known in the art. One of the most common prior art rotary screening apparatuses is known as a trommel screening device, and is generally cylindrical in shape, open at both ends, and when in use is rotated to sort material by size. The cylindrical trommel screening device is inclined with the material to be processed dumped in the higher end. Rotation of the screen causes the material to tumble towards the lower end. The material, which is smaller than the openings in the screens that define the periphery of the cylinder, fall through those openings to be carried off by conveyors, or otherwise collected for further processing, while the coarser fraction of the material is discharged out the lower end.

Often, the material to be screened is exposed to the environment for considerable periods of time before being processed, and thereby accumulates moisture. While some of the material processed by trommel screens is inherently moist. Those conditions lead to a major problem that occurs when operating these screening devices, that of excessive clogging of the screening material, often referred to as "blinding the screens". The moist material being screen tends to agglomerate and become and become bound or "caked" on the screens. The screening "drums" often have annular imperforate bands by which the rotary screening drum is rotatively supported. These solid portions of the rotary frame also become caked with the agglomerations ("mud") that binds itself thereto. The bound agglomerations impede the longitudinal flow of the material through the drum, thereby detrimentally effecting the efficiency of the screening operation. Excessive clogging of the screens and/or the caking of material on the imperforate portions of the drum requires an increase in the number of operators for the equipment, in order to tend to clearing out of the bound agglomerated material. Further, excessive downtime is required for performing the clearing operations to remove the bound agglomerations. Both the increased labor and increased downtime further reduce the efficiency of the apparatus and screening process.

The prior art has attempted to overcome this problem in a number of different ways. Many systems incorporate heaters to promote drying of the material being screened as it tumbles through the cavity of the trommel screening apparatus. Other systems have attempted to overcome this problem by forming the screens from a set of longitudinal bars that are wrapped by a set of circumferential rings, some of the longitudinal bars being movably mounted to the drum so as to be shifted in place in order to release the clogged material. However, none of these methods have satisfactorily alleviated this problem. The present invention by virtue of its self-clearing screening system automatically breaks up and unclogs agglomerated material from the screens which perform the primary screening function during each rotation of the rotary screening apparatus. The self-clearing screening system prescreens the material screened by the screens that define the periphery of the rotary screening apparatus.

SUMMARY OF THE INVENTION

The present invention is directed to a self-clearing rotary screening system. The system includes a frame having longitudinally extending axis. The frame includes a plurality of longitudinally extending frame members disposed in angularly spaced relationship, one with respect to another, about the axis. The system includes a plurality of first screening members affixed between respective pairs of the plurality of frame members to define a longitudinally extended cavity. A drive system is included in the rotary screening system and is coupled to the frame for rotating the frame about the axis. Still further, the system includes a plurality of second screening members hingedly coupled to respective ones of the plurality of frame members. The second screening members are pivotably displaced responsive to rotation of the frame about the axis.

From another aspect, the present invention is directed to a self-clearing screening system for application to a rotary screening apparatus having a plurality of longitudinally extending frame members disposed in angularly spaced relationship about a rotational axis thereof and a plurality of fixed screening members extending between respective pairs of the plurality of frame members for rotation therewith. The plurality of fixed screens define a longitudinally extended cavity into which material to be screened is delivered. The system includes a plurality of displaceable screening members disposed within the cavity. Each of the displaceable screening members is pivotably coupled to a respective one of the plurality of frame members. The displaceable screening members are pivotably displaced responsive to rotation of the frame about the axis. By that arrangement, the material to be screened is first screened by the displaceable screening members prior to being screened by the fixed screening members.

From still another aspect, the present invention is directed to a method of retrofitting a rotary screening apparatus with self-clearing screens. The method includes the step of providing a plurality of longitudinally extending screening members and locating at least a portion of the plurality of screening members internal to a longitudinally extended material receiving cavity of the rotary screening apparatus in angularly spaced relationship with respect to a rotational axis of the rotary screening apparatus. The method also includes the step of pivotably mounting the at least a portion of the plurality of screening members a distance one from another so that each of the at least a portion of the screening members strikes an adjacent other of the at least a portion of the plurality of screening members during rotation of the rotary screening apparatus.

From yet another aspect, the present invention is directed to a self-clearing screening system for application to a rotary screening apparatus having a rotary frame adapted for rotation about a rotational axis thereof. The rotary screening apparatus includes a plurality of screens mounted to the rotary frame for rotation therewith. The plurality of screens define a longitudinally extended cavity into which material to be screened is delivered. The self-clearing screening system includes a plurality of displaceable members disposed within the cavity. Each of the displaceable members has an end portion coupled to a respective portion of the rotary frame to be displaceable responsive to rotation of the rotary frame about the axis. By that arrangement, binding of the material to be screened and agglomerations thereof are cleared from portions of one of the rotary frame, or the screens, by the displaceable members.

DETAILED DESCRIPTION OF THE PREFERRED EMBODIMENTS

Referring now to FIGS. 1-4, there is shown self-clearing rotary screening system 300 used for sorting material by size. As will be seen in following paragraphs, self-clearing rotary screening system 300 is specifically directed to the concept of providing a screen sorting of material while preventing excessive clogging of the screening members 116 and 210. Self-clearing rotary screening system 300 includes a rotary screening apparatus 100 combined with a displaceable screening system 200. Although self-clearing rotary screening system 300 may be manufactured and sold as a commercial apparatus with the displaceable screening system 200 combined with the rotary screening apparatus 100, the design of the displaceable screening system 200 is also intended for field installation to retrofit rotary screening equipment currently in use.

Figure 1:
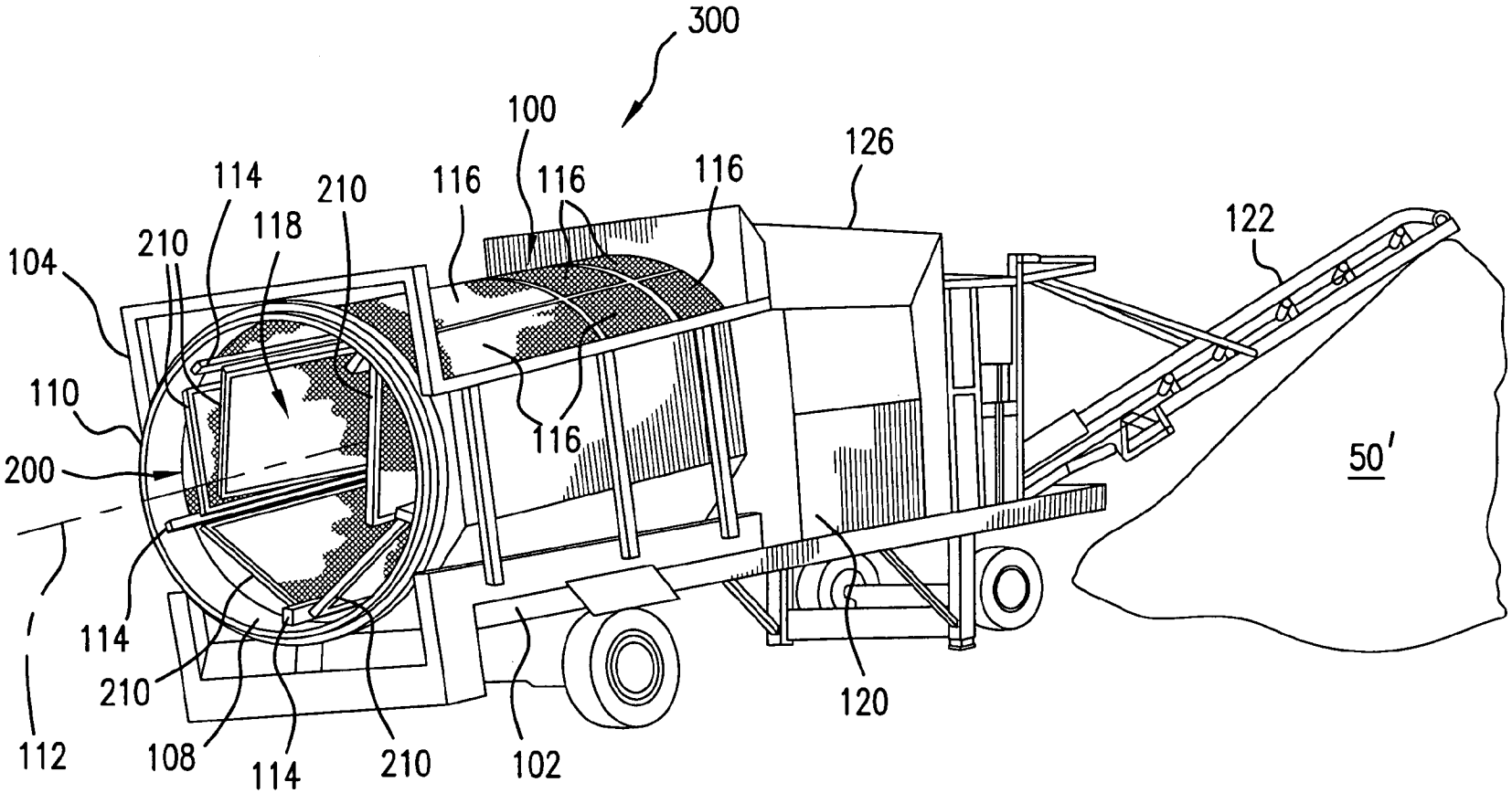
FIG. 1 is a perspective view of a self-clearing rotary screening system in accordance with the present invention.
Figure 2:
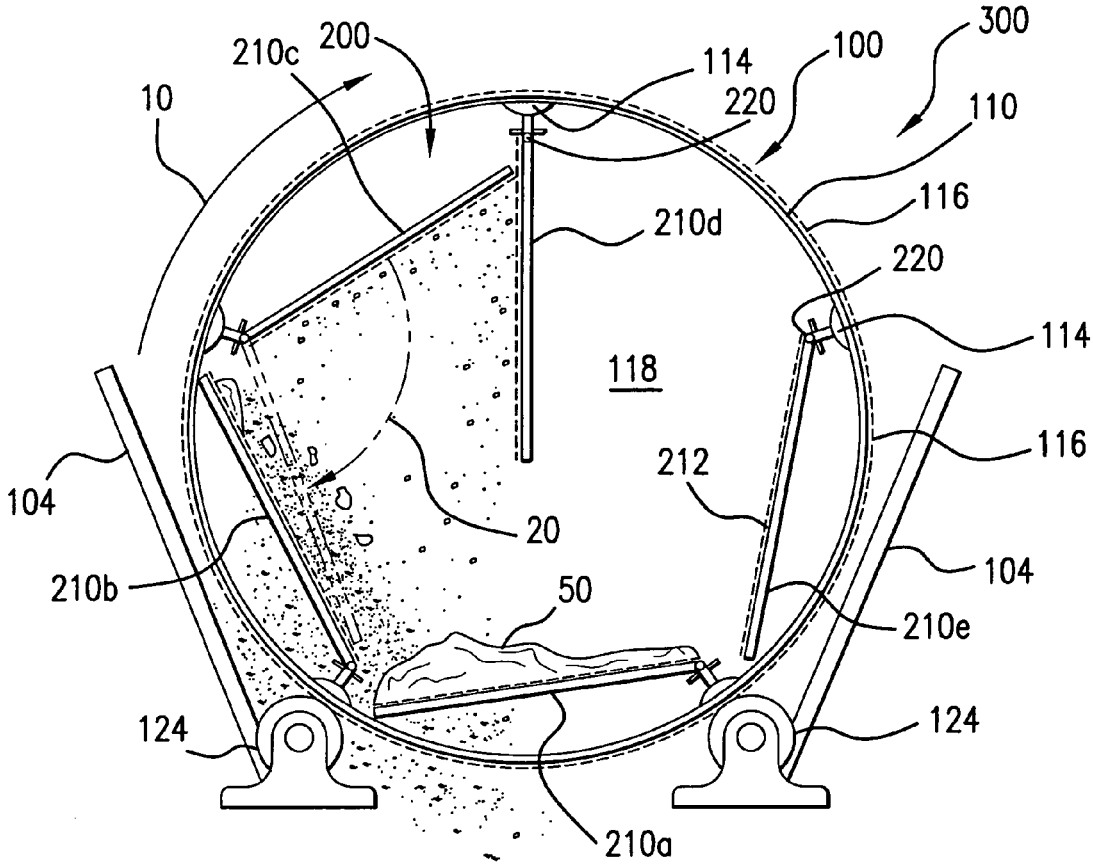
FIG. 2 is a diagrammatic illustration of the present invention showing the operation thereof.

Referring particularly to FIGS. 1 and 2, self-clearing rotary screening system 300 is shown to include the rotary screening apparatus 100, depicted as a portable trommel-type rotary screening device, but may be a fixed installation as well. Typically, such rotary screening devices are drum-shaped with an arcuate outer peripheral wall which is formed by perforated metal, mesh screens or sets of longitudinal bars wrapped by the plurality of circumferential rings. The screens are most often formed of metallic materials, but may be formed of composite compositions. The rotating structure may alternately have a regular polygonal contour, wherein the outer peripheral wall is formed by substantially planar sections that are formed by mesh, perforated metal or spaced bars. All such structures are useful in the practice of the instant invention.

The rotary screening apparatus 100 includes a base 102, which may be adapted for mobility as shown, or fixed in place. Base 102 supports a fixed framework 104 and a rotary frame 110, to which a plurality of fixed screening members 116 are secured. The rotary frame 110 has a longitudinal axis 112 about which it rotates, carrying the fixed screening members 116 therewith. Screening members 116 form an outer peripheral wall of the rotating frame 110 and define a longitudinally extended cavity 118 into which the material 50 to be separated is fed.

Particulate material 50 to be separated by the rotary screening apparatus 100 is fed into the cavity 118 through a hopper 126. The fines pass through the screening members 210, 116 as the rotary frame 110 is rotatively driven by a drive system 120 about the longitudinal axis 112. Drive system 120 is conventional and thus the details thereof are not described herein. Typically, the rotary frame 110 is disposed at an angle, with the material 50 being supplied to the higher end so that the rotation of the rotary frame 110, and screens 210, 116 therewith, causes the material to tumble towards the lower discharge end 108. The fines 50' which pass through the screens 210, 116 are deposited on a conveyor beneath the rotary frame 110 (not shown) and carried to an outgoing conveyor 122 for transport away from the system 300, an arrangement which is well known in the art. The balance of the material 50, the material that is too coarse to pass through the screens, exits the apparatus 100 from the discharge end 108 to be carried away by other conveyors or material moving equipment.

Rotary frame 110 includes a plurality of longitudinal frame members 114, disposed in angularly spaced relationship with respect to the longitudinal axis 112. The plurality of longitudinally extended frame members 114 are joined to the ends of the rotary frame 110 and may have any number of intermediate orthogonally directed frame members extending therebetween, not important to the inventive concepts being disclosed herein. The fixed screening members 116 span between adjacent longitudinally extending frame members 114, and are angularly spaced one from another. Depending upon the longitudinal extent of the rotary frame 110, multiple fixed screening members 116 may be disposed longitudinally one adjacent another, as shown in FIG. 1. As previously mentioned, screening members 116 may have an arcuate contour, as represented in the Drawing Figures, or may be planar to form the contour of the cavity 118 as a regular polygon. Displaceable screening system 200 is secured to the rotary frame 110, and in particular, each of a plurality of displaceable screening members 210 are pivotally coupled to a respective one of the longitudinal frame members 114. Thus, at least a portion of the displaceable screening members 210 are disposed in angularly spaced relationship. Depending upon the longitudinal extent of the rotary frame 110, each of the angularly spaced screening members 210 may be disposed in longitudinally spaced relationship with respective ones of the remaining portion of the plurality of displaceable screening members 210.

Referring now more particularly to FIG. 2, the operation of the displaceable screening system 200 is illustrated. Displaceable screening system 200 includes a plurality of displaceable screening members 210 respectively pivotally coupled to the plurality of longitudinal frame members 114. Each displaceable screening member 210 includes a screen 212 which may be formed of a perforated sheet material, a mesh or a "grizzly bar" structure. The term grizzly bar screen is well known in the art and descriptive of an apparatus having a heavy screening surface usually formed of spaced parallel straight bars.

Figure 3:
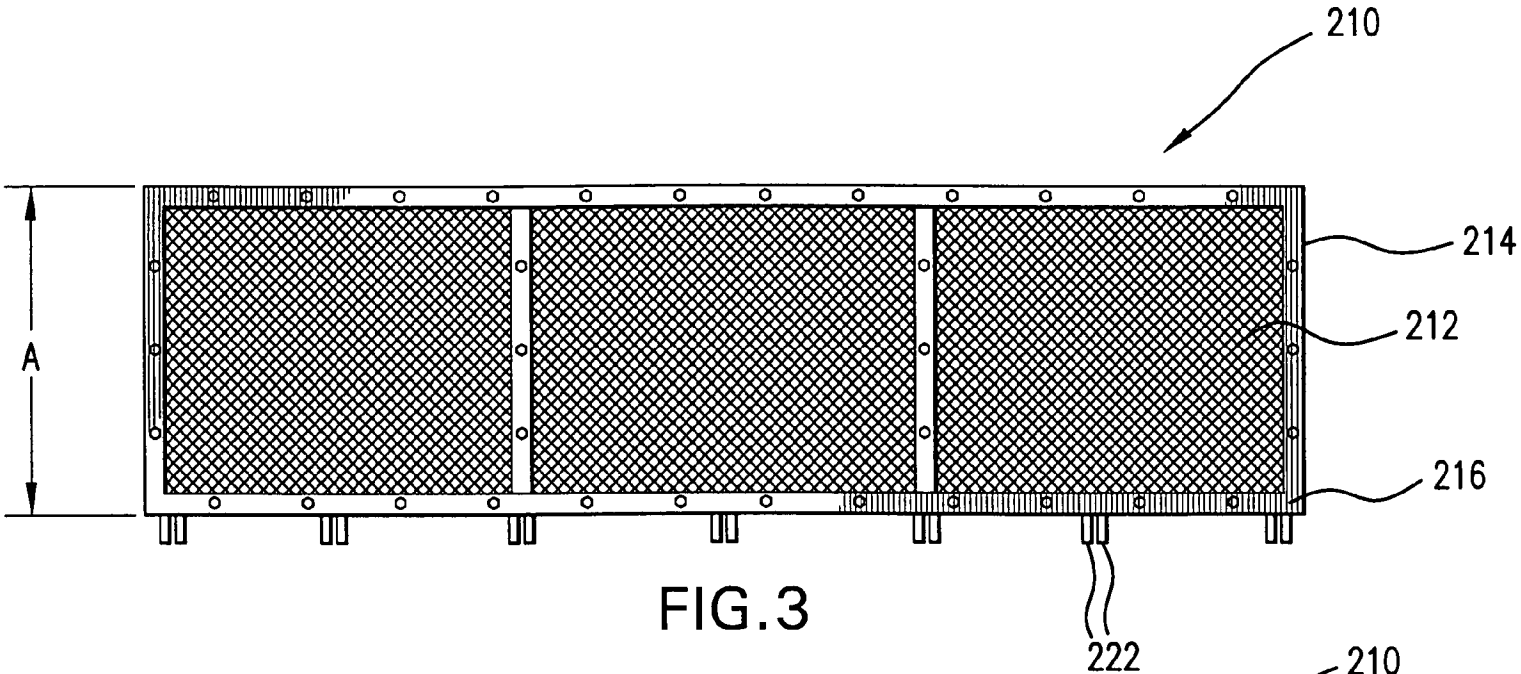
FIG. 3 is a plan view of a displaceable screen of the present invention.
Figure 4:
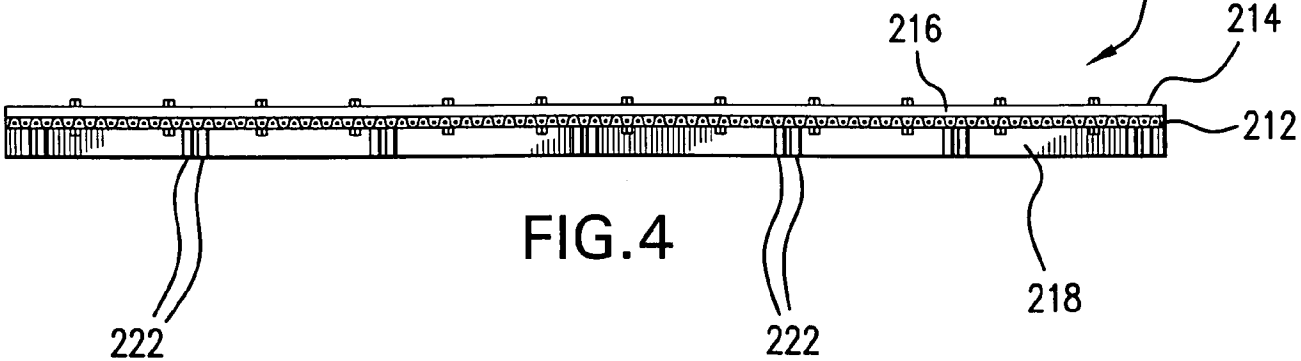
FIG. 4 is an end view of a longitudinal side of the displaceable screen of the present invention.

As further shown in FIGS. 3 and 4, each displaceable screening member 210 includes a frame 214 which supports the screening material 212. The frame 214 forms a substantially rigid structure supporting the screening material 212. The screening material 212 may be welded to the frame 214, or as shown in the drawings, it may be made replaceable by clampingly engaging the screening material between framing members 216 and 218. The upper frame plate 216 overlays the screening material and is fastened by a plurality of fasteners to the lower frame 218. The fasteners may be bolts, rivets or the like. Lower frame 218 may have an angular, channel-shaped, tubular-shaped or other stiffening cross-sectional contour to provide rigidity for the displaceable screening member 210.

Extending transversely from one longitudinal side of the lower frame 218, are a plurality of pivot plates 222 disposed in longitudinally spaced relationship. The pivot plates 222 may be disposed in spaced pairs to define hinge knuckles which are pivotally coupled in the conventional manner to corresponding knuckles extending from the respective longitudinal frame members 114, or hinge plates (not shown) mounted thereto. As the hinge construction of the displaceable screening members 210 are well known in the art, such is not described in any further detail herein. The longitudinal dimension of the displaceable screening members 210 is determined by practical considerations relating to manufacturability, ease of assembly and the longitudinal dimensions of the rotary frame 110, as examples. Whereas, the lateral dimension A of each of the displaceable screening members 210 is established in order to facilitate the self-clearing function of the displaceable screening members. The dimension A is of sufficient dimension so that at a given position during rotation of the rotary frame 110 a displaceable screening member 210 will contact one other displaceable screening member 210 before striking yet another displaceable screening member 210.

Referring back to FIG. 2, the plurality of screening members 210 which are disposed within the cavity 118 are each hingedly mounted to a respective one of the longitudinal frame members 114. Thus, as the rotary frame 110 rotates about the longitudinal axis 112, as indicated by directional arrow 10, the displaceable screening members 210 are affected by gravity to be pivotally displaced as a function of their position during the rotation of the rotary frame 110. As illustrated, the particulate material 50 to be screened accumulates on the lower most displaceable screening member 210*a* and as that screening member is displaced to the position of displaceable screening member 210*b*, the material 50 which has not passed through the screening material 212 begins to tumble down toward the displaceable screen that is now in the position of displaceable screening member 210*a*.

As the rotary frame 110 rotates still further, the displaceable screening member in the position of displaceable screening member 210*c*, swings through an arc indicated by the directional arrow 20, to strike displaceable screening member in the position of displaceable screening member 210*b*, at that point in time, the screening member that was in position 210*c* overlaps the screening member which is in position 210*b*. Obviously, earlier in the rotational cycle, the displaceable screening member in position 210*d* had overlapped the screening member in position 210*c* when it was in the position of the screening member 210*b*. That overlap created in interference which had to be overcome by the effects of gravity on the screening member in the position of screening member 210*c*. Thus, the rotary frame 110 must rotate through a particular angular extent before the displaceable screening member in the position of screening member 210*c* drops down to strike the adjacent screening member 210*b*. That angular extent is greater than if there had not been the interference between the screens, thereby increasing the potential energy of the screen in the position of screening member 210*c* when it swings free to strike the screen in the position of the screening member 210*b*.

The interference between the two screening members in positions of the screening members 210*c* and 210*d* will have at least two beneficial effects. First, as the distal edge of the screening member in the position of screening member 210*c* slides along the surface of the screening member in the position 210*d*, it will scrape residual caked debris therefrom and cause vibration of the screening member in position 210*d*, which further aids in clearing material clogging the openings of the screen. Still further, the scraping by screening member 210*c* also creates a vibration in that screening member that aids in loosening clogged material thereon. Then, when the displaceable screening member 210*c* strikes the screening member 210*b*, such further unclogs the screening material thereof. During further rotation, as the displaceable screening member moves from the position of the position 210*d* to 210*e*, the displaceable screening member will have yet another impact that provides a further opportunity to "knock" free any caked on material.

That self-clearing process then repeats continually as the rotary frame 110 is rotated about the longitudinal axis 112 by the drive system 120. Although not important to the inventive concepts disclosed herein, the drive system 120 may include rollers 124 for support of the rotary frame 110 during rotation thereof. Rollers 124 may also be driven rollers to impart the rotational force to the rotary frame 110, for lighter duty applications. For heavy duty applications the rollers may be replaced by a gear drive system to positively drive the rotary frame 110.

Figure 2A:
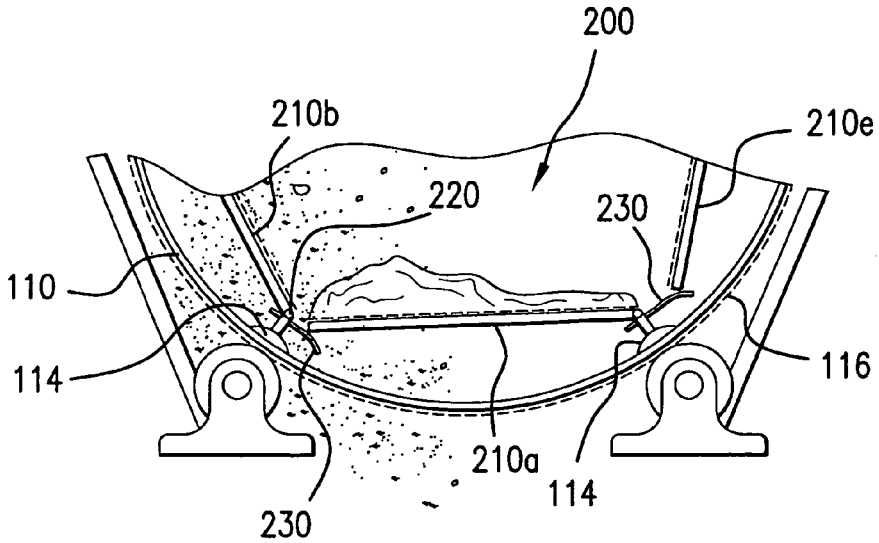
FIG. 2*a* is a cut-away diagrammatic view showing the addition of a stop plate to the structure shown in FIG. 2.

In FIG. 2*a*, there is shown displaceable screening system 200 including a plurality of stop plates 230 which extend from each respective longitudinal frame member 114. Each stop plate 230 limits the displacement of an adjacent displaceable screen member 210, the stop plate 230 extending from the corresponding longitudinal frame member 114 a distance sufficient to support a distal end of the adjacent displaceable screening member 210. Depending upon the particulate material 50 being screened, large pieces or agglomerations of material can become wedged between the distal edge of the screening member in the position of displaceable screening member 210*a*, preventing its subsequent pivotal displacement during the rotation of the rotary frame 110. The stop plates 230, which extend longitudinally a distance equivalent to that of the displaceable screening members, prevent the lodging of material between a respective distal edge of the displaceable screening members 210 and a corresponding adjacent longitudinal frame member 114. The stop plates 230 may be formed of metal, a composite material, or rubber and are intended to prevent lodging of particulates in any gap between the distal end of the displaceable screening members 210 and adjacent longitudinal frame member 114, which otherwise might become wedged therebetween.

Figure 5:
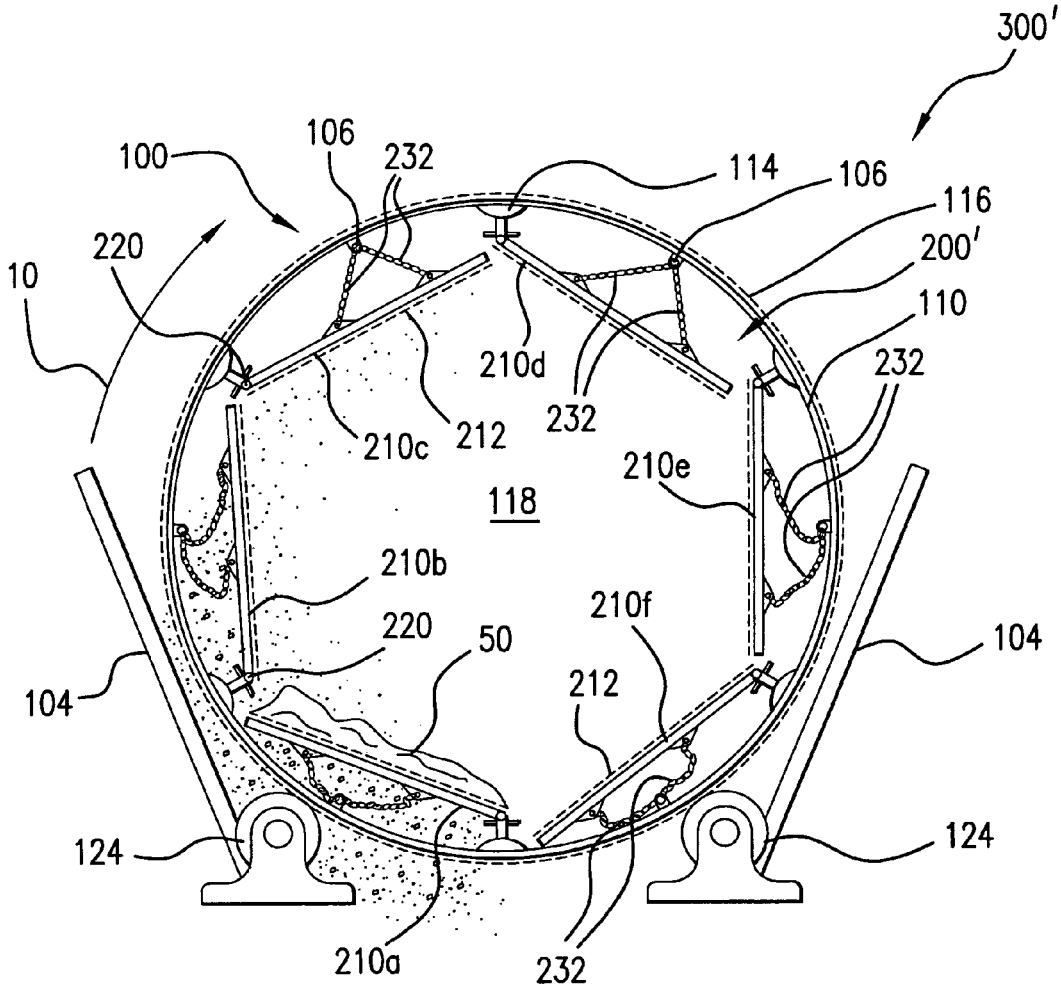
FIG. 5 is a diagrammatic illustration of the present invention showing a modified structure of the present invention.

Turning now to FIG. 5, self-clearing rotary screening system 300' is shown. Corresponding elements to those described with respect to system 300 are given common reference numerals for those identified in FIGS. 1-4. Self-clearing rotary screening system 300' is incorporated in the rotary screening apparatus 100, shown in FIG. 1, but includes a displaceable screening system 200' which operates in a slightly different fashion from that which was previously described. The structure of each of the individual displaceable screening members 210 is the same as shown and described with respect to FIGS. 3 and 4. However, rather than being freely pivotable as the rotary frame 110 is driven to rotate in the direction shown by directional arrow 10, each of the displaceable screening members 210 includes a structure for limiting the displacement thereof.

Each displaceable screening member 210 is restrained by at least one flexible restraining member 232 coupled between the displaceable screening member and the rotary frame 110. The restraining member 232 may be in the form of a chain, cable or strap which acts to limit the pivotal displacement of the corresponding displaceable screening member. Thus, as the rotary frame 110 rotates about the longitudinal axis 112, the particulate material 50 either passes through the respective screen material 212 or tumbles from one displaceable screening member 210 to fall on a following displaceable screening member 210.

As a displaceable screening member 210 reaches a position somewhere between that of the screening members 210*b* and 210*c*, it begins to pivot about the hinged coupling 220, and being unrestrained by an adjacent displaceable screening member 210, is essentially in a freefall until it reaches the extent of the length of the restraining members 232 coupled thereto. The sudden deceleration of the screening member in the position of displaceable screening member 210*c* by the restraining members 232 provides an impact which frees caked on materials, which then by inertia are displaced into the cavity 118. The impact caused by restraining members 232 can result in recoil of the displaceable screening member 210 which is then followed by subsequent smaller impacts that that will induce a vibration in the screening material 212, to further aid in clearing clogging the screening material 212.

Figure 5A:
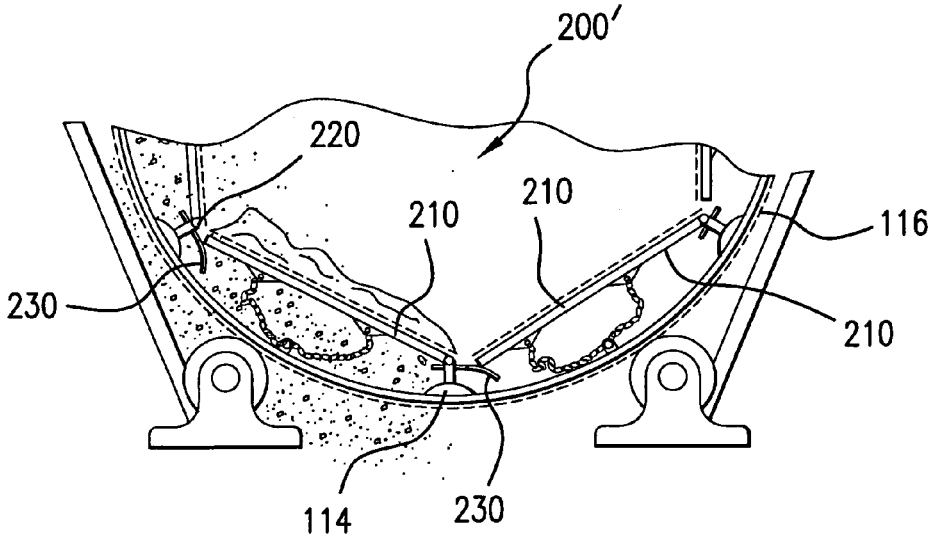
FIG. 5*a* is a cut-away diagrammatic view showing the addition of a stop plate to the structure shown in FIG. 5.

As in system 200, system 200' may include a plurality of stop plates 230, as shown in FIG. 5*a*. As previously described with respect to system 200, the stop plates 230 of system 200' extend from the longitudinal frame members 114 for contact with a corresponding distal end of an adjacent displaceable screening member 210. The stop plates 230 provide a means for limiting the displacement of a respective displaceable screening member 210, and fill the gap between the longitudinal frame member 114 and the corresponding distal end of a displaceable frame member 210. Thus, by the inclusion of the stop plates 230, large particulates or agglomerations of particulates of the material 50 are prevented from being wedged between the distal longitudinal edges of the displaceable screening members 210 and the corresponding adjacent longitudinal frame members 114.

The number of displaceable screening members 210 in displaceable screening system 200, 200' is a function of the perimeter dimension of the cavity 118 of the rotary screening apparatus 100, and may be a function of a number of longitudinal frame members and distance therebetween for retrofit applications. The number of displaceable screening members is not important to the inventive concepts, only that they define a screening surface area that essentially prescreens the particulate material 50 prior to the material passing through the fixed screening members 116. While the embodiment of FIG. 2 is shown with five displaceable screening members 210 angularly spaced within the cavity 118, the embodiments of FIGS. 5 and 6 are shown with six screening members 210, 210', and it should be understood that any number of displaceable screening members 210 may be disposed within the cavity 118 without departing from the spirit or scope of the instant invention.

Figure 6:
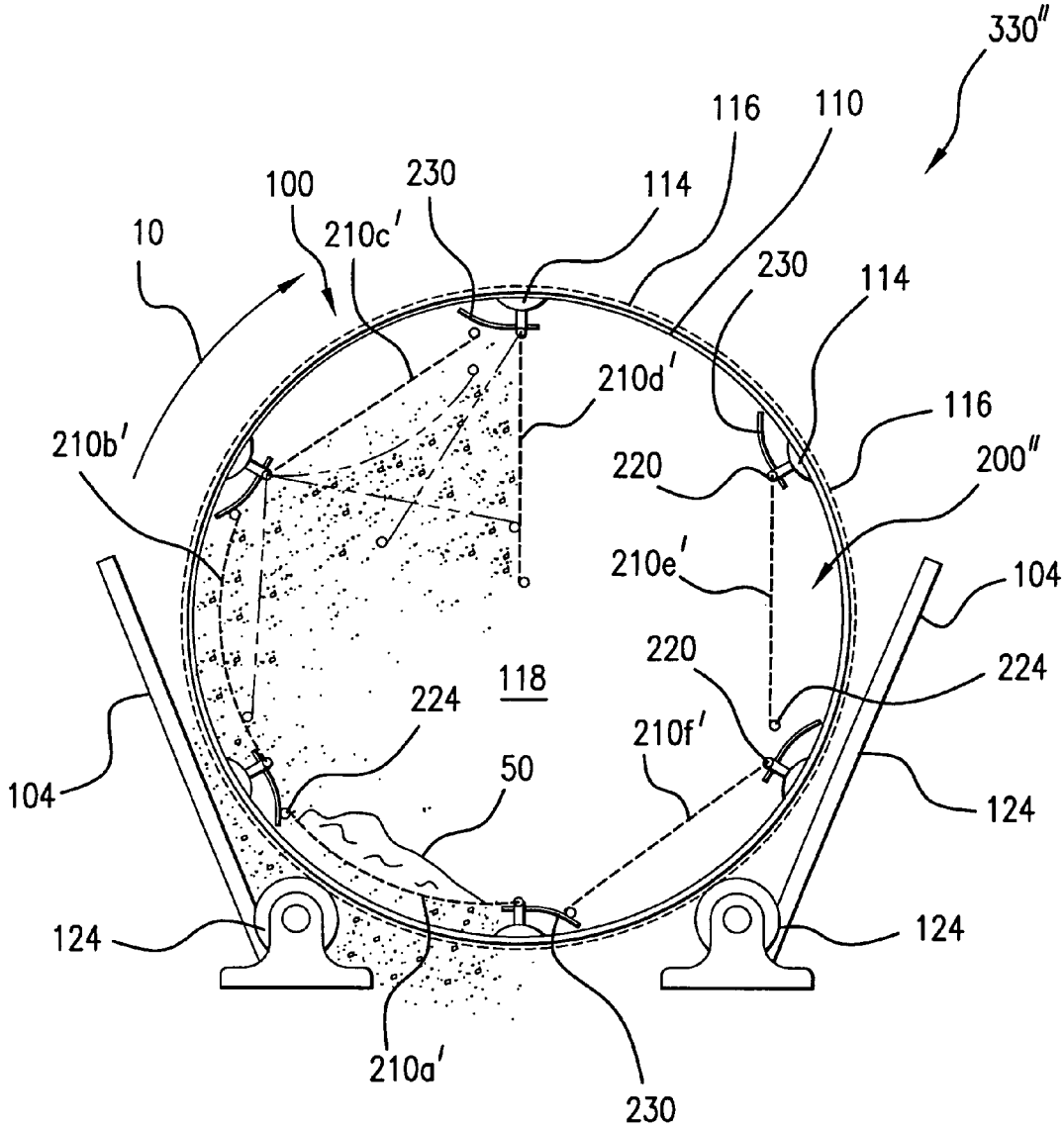
FIG. 6 is a diagrammatic view showing operation of a further modification of the displaceable screening system of the present invention.
Figure 7:
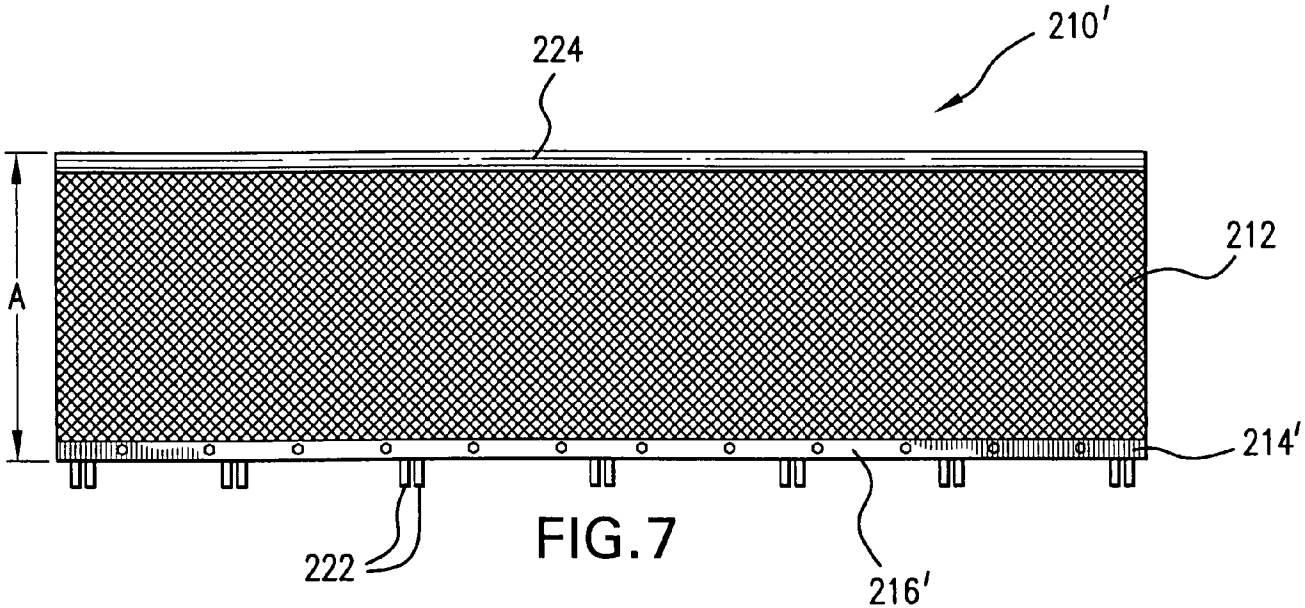
FIG. 7 is a plan view of a displaceable screening member of the displaceable screening system shown in FIG. 6.
Figure 10:
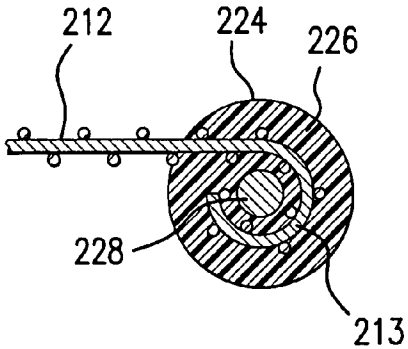
FIG. 10 is an enlarged cross-sectional view of a distal end portion of the displaceable screening member shown in FIG. 7.
Figure 8:
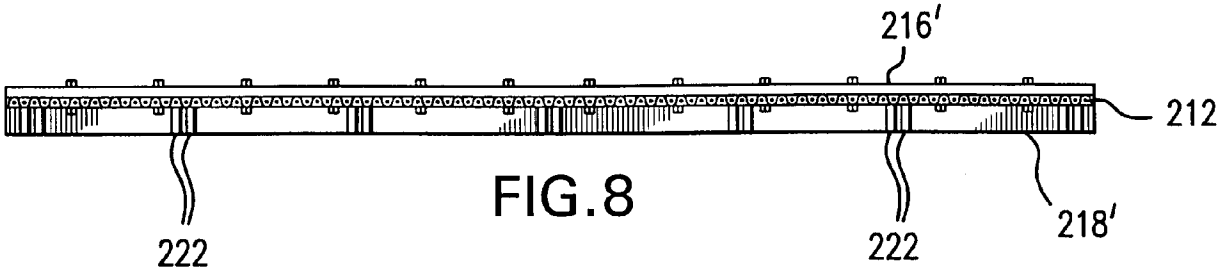
FIG. 8 is an end view showing a longitudinal side of the displaceable screening member of FIG. 7.
Figure 9:
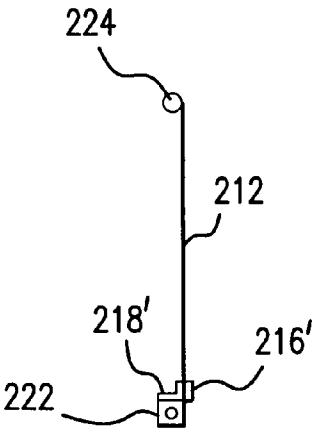
FIG. 9 is a lateral end view of a displaceable screening member of FIG. 7.

Self-clearing rotary screening system 300" is shown in FIG. 6. Corresponding elements to those described with respect to system 300 and 300' are given common reference numerals for those identified in FIGS. 1-5A. Self-clearing rotary screening system 300" includes a displaceable screening system 200" combined with the rotary screening apparatus 100. Displaceable screening system 200" includes a plurality of displaceable screening member 210*a'*-210*f'*. As will be discussed in following paragraphs, rather than including a rigid framework, each of the displaceable screening members 210*a'*-210*f'* are flexible structures to increase the vibratory effects that result from the displacement of the screens during rotation of the rotary frame 110. As in prior examples, the plurality of displaceable screening members 210*a'*-210*f'* are pivotally coupled to respective longitudinal frame members 114 by hinge type pivotal couplings. Thus, as the rotary frame 110 rotates, as indicated by directional arrow 10, the particulate material 50 being screened which accumulates on the displaceable screening member in the position of the displaceable screen 210*a'* will tumble from the displaceable screen when it is in the position of displaceable screen 210*b'*.

As the rotary frame 110 continues to rotate, the displaceable screen in the position of displaceable screen 210*c'* will be effected by gravity to swing down and strike the displaceable screen in the position of displaceable screen 210*d*'. The distal end 224 of the displaceable screen 210*c*' will strike the adjacent screen 210*d*' and due to the flexible nature of the screen and the swinging of the screen 210*d*', bounce and scrape therealong until it is free of the displaceable screening member 210*d*'. That action induces vibration in both of the two interacting displaceable screening members. Once free of contact with the adjacent screening member, the screening member in the position of the displaceable screening member 210*c*' will then strike the displaceable screening member in the position of displaceable screening member 210W, impacting thereon, recoiling and impacting again, causing vibrations within the screen 210*b*' and itself. The vibration and impacts result in at least a portion of the otherwise clogging particulates to be displaced from each of the screening members. Further, any residual particulates imbedded in the screening member 210*c*' will be removed when that screen is in the position of displaceable screen 210*d*' and is struck and scraped by the screen is then positioned in the position of the screening member 210*c*'.

Particulates that remain embedded in the screen of the displaceable screening member 210*b*', have two more opportunities to be jarred loose as the screening member is advanced into the positions of displaceable screening member 210*c*' and 210*d*'. As the rotary frame continues to rotate, the displaceable screen that was in the position of screening member 210*c*', becomes repositioned as it is brought into the positions of screening members 210*e*' and 210*f*'. That cycle repeats for each of the displaceable screens as the rotary frame 110 is rotated about the longitudinal axis. In order to avoid any of the particulate material 50 from wedging between the distal end 224 of any of the displaceable screening members and a respective longitudinal frame member 114, each of the longitudinal frame members 114 are fitted with a stop plate 230, which supports the distal end 224 of an adjacent displaceable screening member 210*a*'-210*f*', as in system 200 and 200'.

Turning now to FIGS. 7-10, the structure of a respective displaceable screening member 210' is shown. The proximal longitudinal side of the screening member 210' includes a frame 214 which secures one longitudinal side of the screening material 212. Frame 214' may be welded to the screening material, or clampingly engage the longitudinal side of the screening member, as shown in the Figures. Frame 214' may include an upper frame plate 216' and a lower frame 218' between which the screening material 212 is clampingly engaged using bolts, rivets, or the like. Lower frame 218' is shown to have an L-shaped cross-sectional contour, but such may also be C-shaped, rectangular like the upper frame plate 216' or tubular in structure. Extending from the lower frame 218, are a plurality of pivot plates 222, which may be arranged in pairs to serve as hinge knuckles for coupling in the conventional manner with corresponding structures extending from respective longitudinal frame members 114, or hinge plates (not shown) mounted to longitudinal frame members, and form a complimentary part of the pivotal coupling 220.

In order to stiffen the distal end 224 of the displaceable screening members 210', a distal end portion 213 of the screening material 212 is wrapped around a core member 228. Core member 228 may be formed of steel wire, steel cable, a composite material being a tubular or solid rod structure, or another structure which provides stiffening and strength for enduring the repeated impacts to which each of the displaceable screening members are exposed. To further add strength and resiliency, the distal end portion 224 is encased with polymeric composition 226. Polymeric composition 226 may be a urethane material molded over the distal end, as well as materials such as epoxy, various thermoplastics and synthetic or natural rubber compositions. By that arrangement, the distal end 224 of the displaceable screening member 210' acts as a mallet for imparting impact and vibrational forces on adjacent displaceable screening members 210' during the rotative cycle of the rotary frame 110. Where further stiffness of the screening members 210' is desired, the core member 228 of each screening member 210' is extended in length and borders both longitudinal ends of the screening material 212. The screening material 212 at each longitudinal end is wrapped around the core member 228 in the same manner as the distal end portion 213. As an alternate to extending the length of core member 228, individual core members can be used at each of the longitudinal ends of each screening member 210' with the screening material wrapped thereon.

As in the displaceable screening members 210, the longitudinal dimension of the displaceable screening members 210' is determined by practical considerations relating to manufacturability, ease of assembly and the longitudinal dimensions of the rotary frame 110, as examples. Whereas, the lateral dimension A of each of the displaceable screening members 210' is established in order to facilitate the self-clearing function of the displaceable screening members. The lateral dimension A is of sufficient dimension so that at a given position during rotation of the rotary frame 110 a displaceable screening member 210' will contact one other displaceable screening member 210' before impacting against yet another displaceable screening member 210'.

Figure 11:
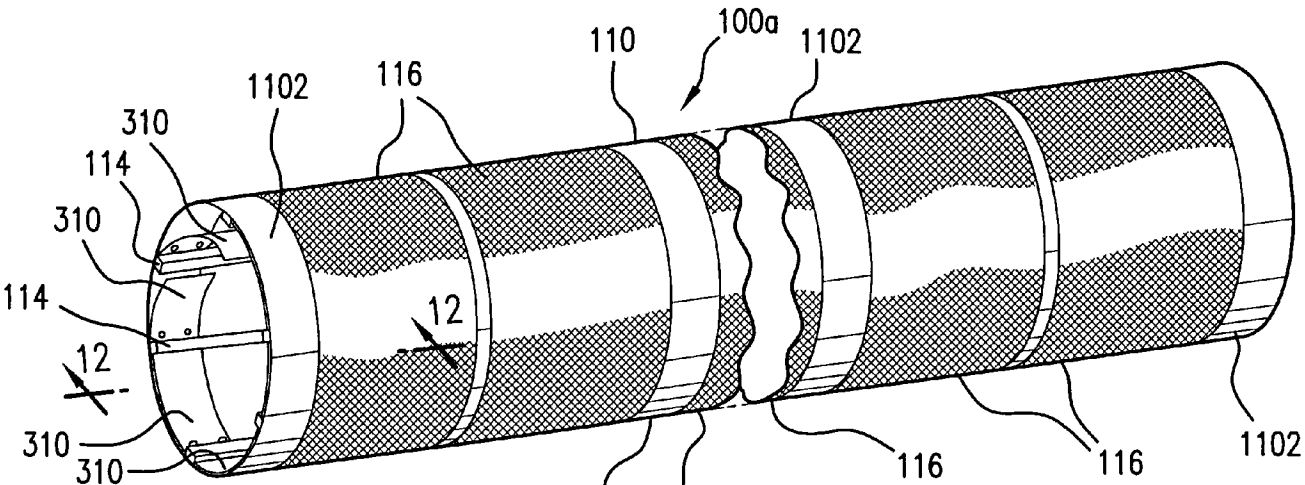
FIG. 11 is a perspective view showing displaceable belts of the present invention.
Figure 12:
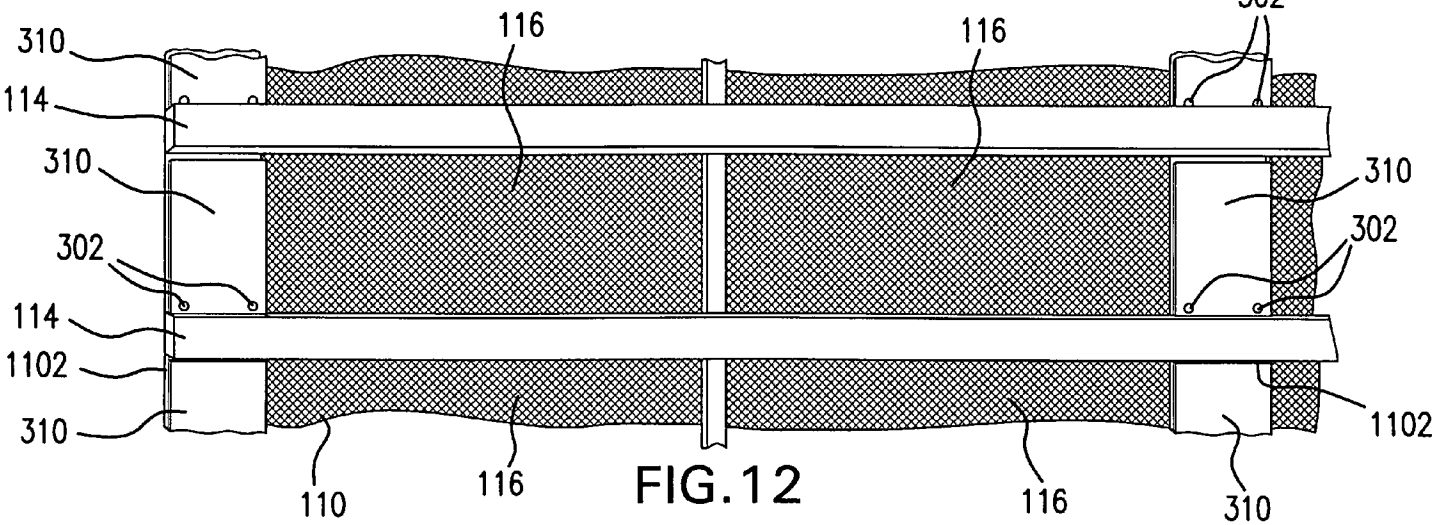
FIG. 12 is a sectional view of the displaceable belts of the present invention taken across the section line 12-12 in FIG. 11.
Figure 13:
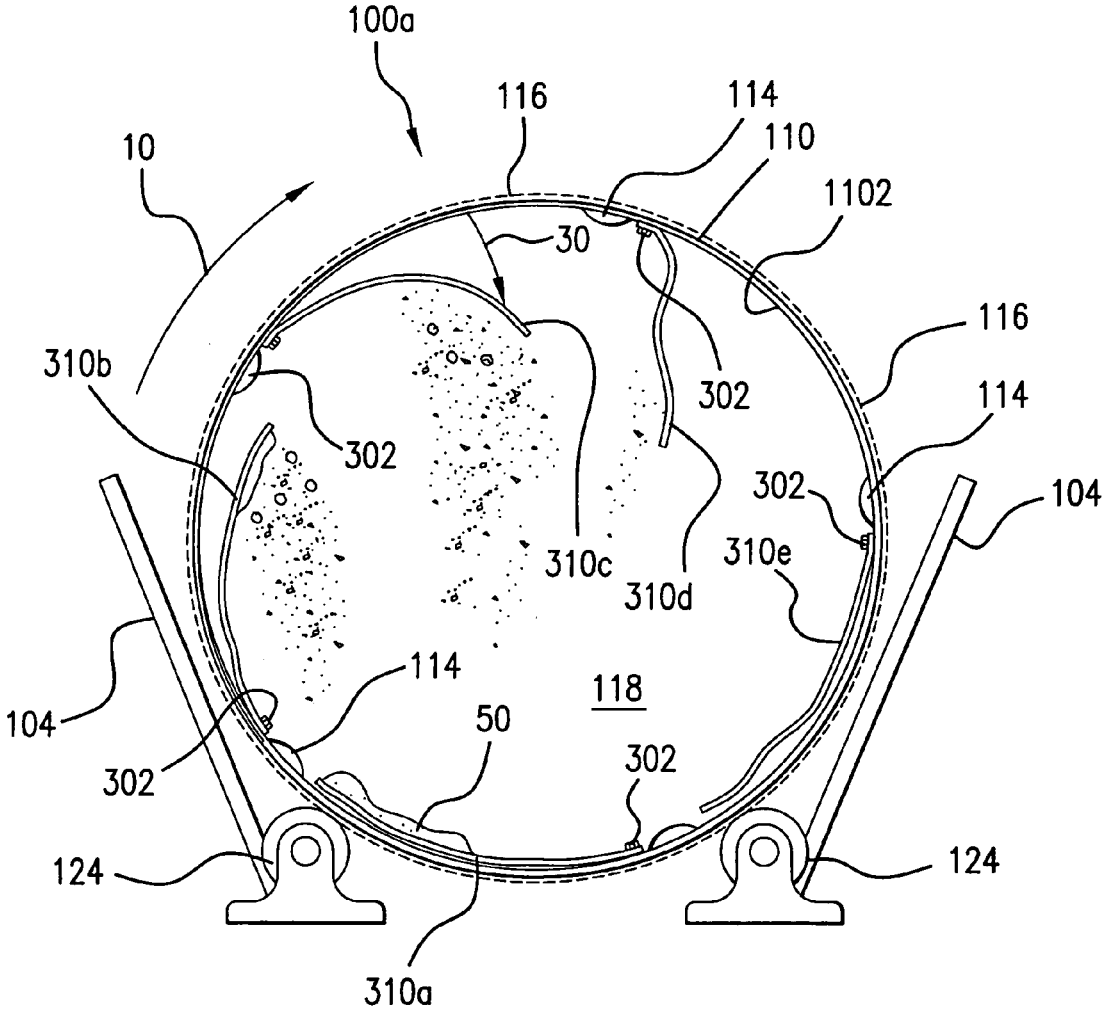
FIG. 13 is a diagrammatic view showing operation of the displaceable belts of the present invention.

With reference to FIGS. 11, 12 and 13, large rotary screening apparatuses require rotative support at intermediate locations along their longitudinal axis. Rollers of the fixed frame contact the outer surface of annular rotary frame members 1102 that are longitudinally spaced along the rotational axis of the rotary frame 110. The internal surface of the annular rotary frame members 1102 provides an imperforate surface upon which agglomerations of material to be screened become bound and buildup. That buildup of material then impedes the longitudinal flow of material to be screened through the rotary screening apparatus. In order to prevent the buildup of bound agglomerations of material, a plurality of displaceable members in the form of flexible belt members 310 are provided to substantially overlay the imperforate portions 1102 of the rotary screening apparatus 100*a*. As the displaceable belt members 310 function to provide self-clearing of the imperforate portions of the rotary screening apparatus 100*a*, they can be used in combination with the displaceable members 210, 210', and those to be discussed in following paragraphs that provide clearing for the screens 116.

The flexible belt members 310 may be formed of natural or synthetic rubber, various reinforced or unreinforced polymeric materials, leather and other flexible materials. Salvaged conveyor belts have been cut to size and also successfully used to form the belt members 310. Each of the belt members 310 is dimensioned to substantially overlay a portion of a corresponding annular rotary frame member 1102 disposed between a respective pair of angularly spaced longitudinal frame members 114. Multiple belt members 310, rather than one, may be angularly spaced in each arcuate sector of the rotary frame, between the respective pairs of angularly spaced longitudinal frame members 114, particularly where the screening apparatus is of large diameter. However, consideration must be given to the fact that belt members of greater length are subject to a greater amount of displacement activity and thereby tend to be more effective at breaking up the agglomerations of material bound thereto. The trailing end portion of each belt member 310, with respect to rotation of the rotary frame 110, is secured to the rotary frame 110. The belt members may be affixed to the corresponding annular rotary frame member 1102 itself by conventional fasteners 302, as shown in the drawing figures. Alternately, each of the belt members may be similarly fastened to a portion of a respective adjacent longitudinal frame member 114.

Referring in particular to FIG. 13, the plurality of belt members 310, which are disposed within the cavity 118, are each mounted adjacent one end thereof to the rotary frame 110, as previously described. The cantilever type mounting and flexibility of the belt members forms a "living hinge" type displacement of the distal portion thereof relative to the proximal end that is affixed to the rotary frame 110. Thus, as the rotary frame 110 rotates about the longitudinal axis, as indicated by directional arrow 10, the free distal end portions, and in fact a major extent of the flexible belt members 310 are affected by gravity to be displaced as a function of their position during the rotation of the rotary frame 110. As illustrated, the particulate material 50 to be screened accumulates on the lower most belt member 310*a* and as that belt member is displaced to the position of belt member 310*b*, the material 50 begins to break up and tumble down toward the belt member that is now in the position of belt member 310*a*, to continue it longitudinal flow through cavity 118 for further screening through the screens 116.

As the rotary frame 110 rotates still further, the belt member in the position of belt member 310*c*, swings through an arc indicated by the directional arrow 30, to cause further of the material to be displaced therefrom. As the rotation continues the to the position 310*d*, the hanging portion of the belt member swings, and due to its flaccid nature undulates to still further displace any caked-on material therefrom. The belt member will return to overlaying the corresponding portion of the annular rotary frame member 1102 when it reaches the position of belt member 310*e*. Depending upon the rotational speed of rotary frame 110, the belt member may "slap" down on the annular rotary frame member 1102, the impact providing a further clearing of any material yet adhered thereto.

Figure 14:
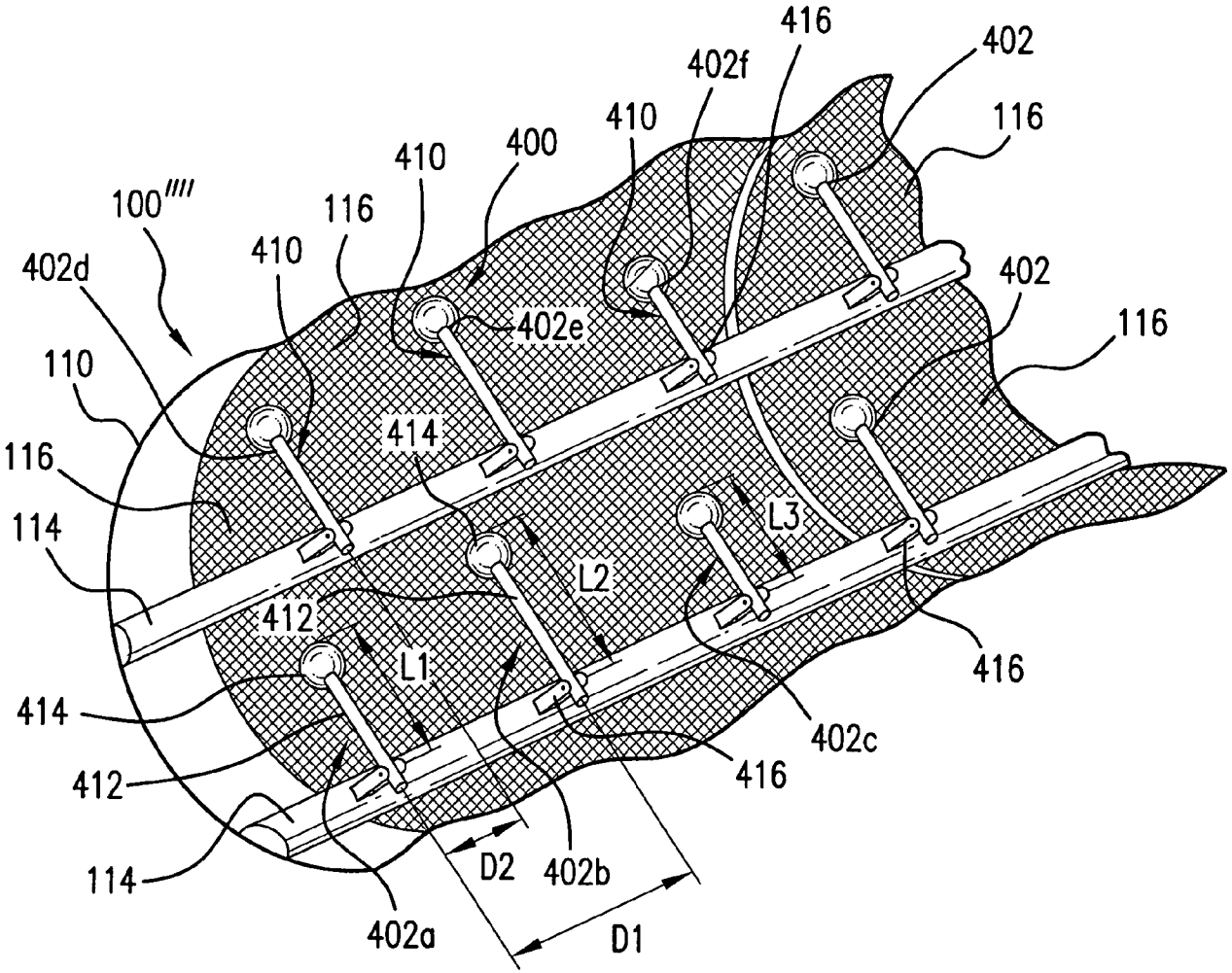
FIG. 14 is a cut-away view showing displaceable mallets of the present invention.
Figure 15:
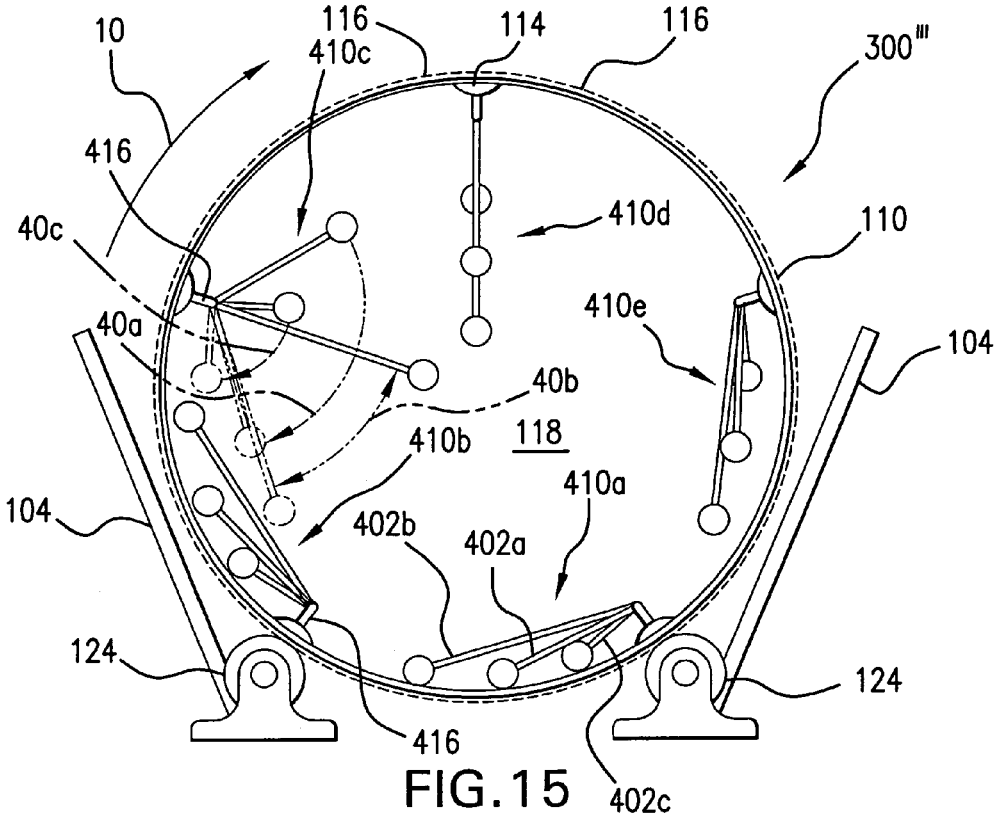
FIG. 15 is a diagrammatic view showing operation of the displaceable mallets of the present invention.
Figure 16:
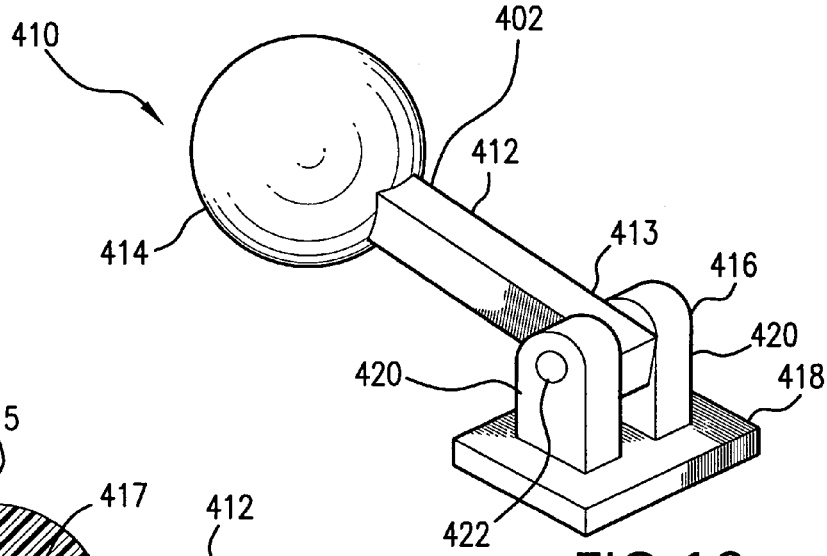
FIG. 16 is a perspective view of a displaceable mallet of the present invention.
Figure 17:
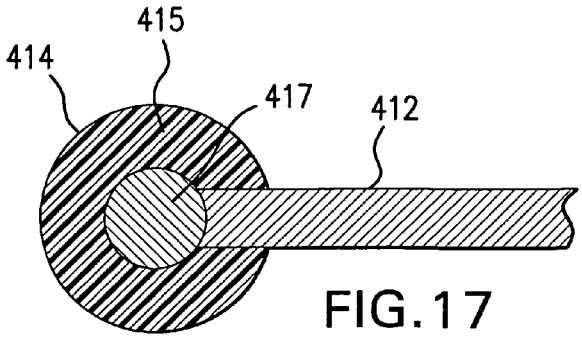
FIG. 17 is an enlarged cross-sectional view of a distal end portion of the displaceable mallet shown in FIG. 16.

Turning now to FIGS. 14-16, there is shown self-clearing system 300''' which includes the rotary screening apparatus 100'''' combined with a screen clearing assembly 400. The screen clearing assembly 400 includes a plurality of displaceable members within the cavity 118 of the rotary frame 110. Each displaceable member is formed by a swinging arm assembly 410 mounted to a respective portion of the rotary frame 110 for impacting corresponding portions of a respective screen 116 of the rotary screening apparatus 100''''. Each of the swinging arm assemblies 410 includes a mallet member 402 and a pivotal mount 416 to which the mallet member is pivotally coupled. The pivotal mount 416 is affixed to the rotary frame 110 by conventional means, such as welding, the use of fasteners or other means not important to the inventive concepts disclosed herein. The mallet member 402 has an elongated arm 412 with a head 414 coupled to a distal end thereof. The particular shape and construction of arm 412 is not important to the invention, as herein described, it is only required that the arm 412 have sufficient structural integrity to function as described herein. To illustrate some variation in shape of arm 412, each arm 412 in FIG. 14 is illustrated as having a cylindrical contour, while in FIG. 16 the arm 412 is illustrated as having a parallelepiped contour. The arm 412 may be of solid or tubular construction from any of a wide variety of metallic or composite materials. The head 414 is formed of a resilient material composition such as natural or synthetic rubber or any of a large number of polymeric compositions. In order to provide the desired impact between the head 414 and a respective portion of a screen 116, it is preferred that the head be weighted to readily swing and impact against a respective screen 116 with sufficient force to breakup and displace agglomerations of material that would otherwise clog the screen. As shown in FIG. 17, the head 414 is formed with a core 417 coupled to a distal portion of the arm 412 to add weight to the head 414. The core 417 may be formed of lead, brass, steel or the like to provide the desired weight to the head 414. A resilient material layer 415 that spreads the impact over a larger area, due to its compressibility, overlies the core 417. The resiliency of layer 415 causes the mallet head 414 to "bounce," resulting in a series of sequential impacts that further serve to clear the screen of bound agglomerations of material.

Screen clearing assembly 400 may be subdivided into a multiplicity of sets of swinging arm assemblies 410, at least a portion thereof being angularly spaced one set from another. Depending upon the longitudinal extent of the rotary screening apparatus 100'''' groups of sets of swinging arm assemblies 410 may be longitudinally spaced within the cavity 118 in order to provide clearing of all of the screens 116 that enclose the cavity 118.

Each set of swinging arm assemblies 410 include a plurality of swinging arm assemblies 410 spaced longitudinally one from another. The swinging arm assemblies 410 of one set are positioned to be longitudinally offset with respect to the swinging arm assemblies 410 of an adjacent angularly spaced set of swinging arm assemblies. Thus, the mallet members 402*a*, 402*b* and 402*c* of one set of swinging arm assemblies 410 are spaced each from the other a Distance D1. The number of swinging arm assemblies that define a set and the distance D1 therebetween each will depend on the size of the rotary screening apparatus and the propensity of the types of material being screened for forming agglomerations the blind the screens. The mallet members 402*d*, 402*e* and 402*f* of the adjacent angularly spaced set of swinging arm assemblies 410 are likewise spaced each from the other by the Distance D1, but are respectively offset from the corresponding mallet members 402*a*, 402*b* and 402*c* by a distance D2. The distance D2 is smaller than the distance D1 and depends on the number of sets of swinging arm assemblies 410 that are circumferentially spaced within the cavity 118, as well as the propensity of the types material being screened for forming agglomerations the blind the screens.

The plurality swinging arm assemblies 410 that define a set may each be formed by a mallet member of a different length to provide variation in the areas being impacted with respect to a direction transverse to the longitudinal direction of the screens. Thus, the mallet member 402*a* may have a length dimension L1, the mallet member 402*b* may have a length dimension L2, and the mallet member 402*c* may have a length dimension L3, where L1, L2 and L3 are not equal to each other. As yet, no particular advantage has been found for any specific relationship between L1, L2 and L3, but it is contemplated that a particular sequence of mallet member lengths may yet be uncovered that more efficiently clears the screens than other sequences of mallet member lengths. At present, it is preferred to select the lengths of the mallet members to impact the corresponding screen at equal subdivisions of its angular extent. The longitudinal sequence of the various lengths of the mallet member may be arbitrary for a set, with all of the other sets of the screen clearing assembly 400 having the same sequence.

Referring further to FIGS. 15 and 16, the plurality of swinging arm assemblies 410 of each set of swinging arm assemblies, which are disposed within the cavity 118, are each pivotally mounted to a respective longitudinal frame member 114, as previously described. Each mallet member 402 is pivotally coupled to a respective pivotal mount 416, the arm 412 having an end portion 413 with a through hole (not shown) through which a pivot pin 422 extends. The pivot pin 422 is disposed in aligned openings formed in a pair of spaced knuckles 420 extending from a mounting base 418, and between which the end 413 of arm 412 is disposed. Mounting base 418 is secured to a respective longitudinal frame member 114, by welding, fasteners or the like.

Thus, as the rotary frame 110 rotates about the longitudinal axis, as indicated by directional arrow 10, the head 414 of each mallet member is affected by gravity to be displaced about the pivot pin 422 as a function of their position during the rotation of the rotary frame 110. As illustrated, each mallet member 402*a*, 402*b*, 402*c* of a representative set of swinging arm assemblies 410 remains substantially stationary in a first position as the set of swinging arm assemblies is displaced between the positions 410*a* and 410*b*. However, as the rotary frame 110 rotates still further, the mallet members 402*a*, 402*b*, 402*c*, by the time they reach the position of swinging arm assemblies 410*c*, convert their potential energy derived from the rotating structure to kinetic energy; thereby swinging through respective arcs indicated by the directional arrows 40*a*, 40*b*, 40*c*. The mallet members 402*a*, 402*b*, 402*c* swing from the first position, where the heads 414 thereof are in contact with a leading screen 116, to a second position where the heads 414 of the mallet members 402*a*, 402*b*, 402*c* impact corresponding portions of a trailing screen 116, causing bound agglomerations of the material being screened to be displaced therefrom. The resiliency of the heads 414 results in the mallet members bouncing back through their respective arcs and then impacting the trailing screen 116 again. That process will repeat until all of the converted potential energy has been exhausted.

As the rotation continues to the position 410*d*, the mallet members 402*a*, 402*b*, 402*c* swing to a position intermediate the first and second positions to hang down into the cavity 118. By virtue of the position of swinging arm assemblies 410*d*, they regain potential energy. In transitioning from the position of swinging arm assemblies 410*d* to 410*e* the regained potential energy is converted to kinetic energy and the mallet members 402*a*, 402*b*, 402*c* swing toward and impact the leading screen 116. Depending upon the rotational speed of rotary frame 110, the mallet members 402*a*, 402*b*, 402*c* will impact the leading screen with sufficient force to provide a further clearing of any material yet adhered thereto. It should be understood that the leading screen was fist impacted by the mallet members of the set of swinging arm assemblies 410 that angularly precede, with respect to the rotation of rotary frame 110, the mallet members 402*a*, 402*b*, 402*c* whose operational cycle was just described. Using FIG. 14 as a reference, the screen 116 impacted by mallet members 402*a*, 402*b*, 402*c* in the position of swinging arm assemblies 410*e*, is first impacted by the mallet members 402*d*, 402*e*, 402*f* when in the position of swinging arm assemblies 410*c*, but at locations that are offset from one another. Thus it is clear that each set of swinging arm assemblies 410 swing between corresponding first and second positions to impact a respective trailing and leading screen 116 during each rotation of the rotary frame 110.

Although this invention has been described in connection with specific forms and embodiments thereof, it will be appreciated if there is modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is being claimed is:

1. A self-clearing rotary screening system, comprising:

a frame having a longitudinally extending axis, said frame including a plurality longitudinally extending frame members disposed in angularly spaced relationship, one with respect to the others, about said axis;

a plurality of first screening members coupled to said plurality of frame members, each of said plurality of first screening members being affixed between respective pairs of said plurality of frame members to define a continuous envelope of said first screening members surrounding a longitudinally extended cavity open on opposing ends;

a drive system coupled to said frame for rotating said frame about said axis;

a plurality of second screening members disposed within said longitudinally extended cavity and hingedly coupled to respective ones of said plurality of frame members between adjacent pairs of said first screening members, said second screening members being pivotally displaced from a first position screening a material through openings therein to at least a second position shedding residual material into said cavity responsive to rotation of said frame about said axis.

2. The self-clearing rotary screening system as recited in claim 1, further comprising a plurality of restraining members respectively coupled between said plurality of second screening members and said frame for limiting pivotal displacement thereof into said cavity.

3. The self-clearing rotary screening system as recited in claim 1, further comprising a plurality of plate members coupled to said plurality of frame members and extending therefrom in spaced relationship from said first screening members for contact with a distal end portion of a corresponding one of said plurality of second screening members disposed in said first position for preventing material being screened from blocking displacement of said second screening members.

4. The self-clearing rotary screening system as recited in claim 1, wherein each of said plurality of second screening members is dimensioned for striking an adjacent one of said angularly spaced second screening members disposed in said second position during a transition thereof from said first position to said second position.

5. The self-clearing rotary screening system as recited in claim 4, wherein each of said plurality of second screening members is dimensioned and angularly spaced from adjacent second screening members a dimension so that the striking of one of said plurality of second screening members by another is followed by the striking second screening member scraping a surface of the struck second screening member.

6. A self-clearing screening system for retrofit application to a rotary screening apparatus having a rotary frame with a plurality longitudinally extending frame members, each of the frame members being disposed in angularly spaced relationship with respect to the other of the frame members about a rotational axis of the rotary frame, the apparatus including a plurality of fixed screening members extending between respective pairs of the plurality of frame members for rotation therewith, the plurality of fixed screening members defining a longitudinally extended cavity into which material to be screened is delivered, the system comprising:

a plurality of displaceable screening members disposed within the cavity, each of said displaceable screening members being pivotally coupled to a respective one of the plurality of angularly spaced frame members between adjacent pairs of said fixed screening members, said displaceable screening members being pivotally displaced from a first position screening the material to be screened through openings therein to at least a second position shedding residual material into said cavity responsive to rotation of the rotary frame about said axis, wherein the material to be screened is first screened by said displaceable screening members prior to being screened by the fixed screening members.

7. The system as recited in claim 6, wherein each of said plurality of displaceable screening members is dimensioned for striking an adjacent one of said angularly spaced displaceable screening members disposed in said second position during a transition thereof from said first position to said second position.

8. The system as recited in claim 6, further comprising a plurality of restraining members respectively coupled between said plurality of displaceable screening members and corresponding frame members for limiting pivotal displacement thereof into said cavity.

9. The system as recited in claim 6, further comprising a plurality of plate members coupled to the plurality of frame members and extending therefrom in spaced relationship from said fixed screening members for contact with a distal end portion of a corresponding one of said plurality of displaceable screening members disposed in said first position for preventing the material being screened from blocking displacement of said displaceable screening members.

10. A method of retrofitting a screening drum of a rotary screening apparatus with self-clearing screens, the method including the steps of:

a. providing a plurality of longitudinally extending screening members;

b. locating at least a portion of said plurality of screening members internal to a longitudinally extended material receiving cavity of the screening drum in angularly spaced relationship with respect to a rotational axis of the rotary screening apparatus; and, c. pivotally mounting said at least a portion of said plurality of screening members for displacement from a first position screening a material through openings therein to at least a second position shedding residual material into said material receiving cavity responsive to rotation of said screening drum, said at least a portion of said plurality of screening members being mounted at an angular separation distance one from another and being dimensioned so that (i) each of said at least a portion of said plurality of screening members strikes an angularly spaced adjacent one of said at least a portion of said plurality of screening members disposed in said second position during a transition thereof from said first position to said second position, and (ii) striking another angularly spaced adjacent one of said at least a portion of said plurality of screening members disposed in the first position subsequent to striking said angularly spaced adjacent one of said at least a portion of said plurality of screening members disposed in said second position.

11. The method of claim 10, where the step of locating includes the step of positioning a further portion of said plurality of screening members in longitudinally spaced relationship respectively with each of said angularly spaced portion of said plurality of screening members.

12. A self-clearing screening system for application to a rotary screening apparatus having a rotary frame adapted for rotation about a rotational axis thereof and a plurality of screens mounted to the rotary frame for rotation therewith, the plurality of screens defining a longitudinally extended cavity into which a material to be screened is delivered, the system comprising:

a plurality of displaceable screening members disposed within the cavity, each of said displaceable screening members having a first end portion thereof coupled to a respective portion of said rotary frame to be pivotally displaceable responsive to rotation of said rotary frame about said axis; and a plurality of displaceable belt members disposed within the cavity, each of said belt members being in overlaying contact with a respective imperforate portion of the rotary frame and being affixed thereto for angular displacement of a distal end thereof from said contact with said respective imperforate portion of the rotary frame responsive to rotation of said rotary frame about said axis, wherein binding of the material to be screened and agglomerations thereof are cleared from said respective imperforate portions of said rotary frame by said plurality of displaceable belt members.

13. The system as recited in claim 12, wherein said plurality of displaceable screening members are displaceable from a first position screening the material to be screened through openings therein to at least a second position shedding residual material into said cavity, each displaceable screening member being dimensioned and angularly spaced from other of said displaceable screening members for striking an adjacent one of said plurality of displaceable screening members during a transition thereof between said first and second positions.

14. The system as recited in claim 12, wherein each of said displaceable belt members is formed of an elongated strip of flexible material.

15. The system as recited in claim 14, wherein at least a portion of said plurality of displaceable belt members are angularly spaced one from another to substantial overlay an internal circumferential imperforate surface of said rotary frame.

16. The self-clearing rotary screening system as recited in claim 4, wherein each of said plurality of second screening members is angularly spaced from adjacent other second screening members a dimension for striking an adjacent angularly spaced second screening member disposed in the first position subsequent to striking said second screening member disposed in said second position.

17. The self-clearing rotary screening system as recited in claim 7, wherein each of said plurality of displaceable screening members is angularly spaced from adjacent other displaceable screening members a dimension for striking an adjacent angularly spaced displaceable screening member disposed in the first position subsequent to striking said displaceable screening member disposed in said second position.

* * * * *